US006330779B1

(12) United States Patent
Kinzler

(10) Patent No.: US 6,330,779 B1
(45) Date of Patent: Dec. 18, 2001

(54) INSULATED CEILING FOR METAL BUILDINGS AND METHOD OF INSTALLING SAME

(75) Inventor: Kevin W. Kinzler, Ames, IA (US)

(73) Assignee: Kinzler Construction Services, Inc., Ames, IA (US)

( * ) Notice: Subject to any disclaimer, the term of this patent is extended or adjusted under 35 U.S.C. 154(b) by 0 days.

(21) Appl. No.: 09/605,111

(22) Filed: Jun. 28, 2000

(51) Int. Cl.[7] ..... E04B 1/00; E04G 21/00

(52) U.S. Cl. ..... 52/742.13; 52/404.1; 52/404.3; 52/407.3; 52/309.4; 52/309.5; 52/749.1; 52/746.11; 137/561 A

(58) Field of Search ..... 52/742.13, 404.1, 52/404.3, 407.3, 309.4, 309.5, 749.1, 746.11; 156/71, 78; 264/121; 137/561 A; 239/548, 589, 566

(56) References Cited

U.S. PATENT DOCUMENTS 4,635,423 * 1/1987 Ward ..... 52/476
6,012,263 * 1/2000 Church et al. ..... 52/742.13
6,047,518 * 8/1998 Lytle ..... 52/742.13

* cited by examiner

*Primary Examiner*—Carl D. Friedman
*Assistant Examiner*—Chi Nguyen
(74) *Attorney, Agent, or Firm*—Zarley, McKee, Thomte, Voorhees & Sease

(57) ABSTRACT

A method of forming an insulated ceiling includes attaching an insulated panel to the lower flange of the purlins to form an insulatable space between the panel, the purlins, and the exterior skin of a building. The space is then filled with insulation material. An insulation delivery system can be utilized for the filling process, especially when loose-fill insulation is used. The delivery system includes a blower connected to a source of blowable insulating material, and a special manifold connected to the blower and adapted to deliver the material into the space. The manifold has a manifold plate that is slidingly insertable in the space. The manifold plate includes a peripheral seal and at least one air hole therethrough so that air can escape the space while the insulation is being blown in. The manifold allows the space to be filled with insulating material to a desired density or R-value.

27 Claims, 5 Drawing Sheets

INSULATED CEILING FOR METAL BUILDINGS AND METHOD OF INSTALLING SAME

BACKGROUND OF THE INVENTION

The present invention relates to the field of metal building construction. More particularly, this invention relates to means and methods for insulating a space adjacent the exterior skin of a metal building.

Metal buildings are known for their durability and low exterior maintenance requirements. However, because of the high thermal conductivity of their metal components, fasteners and connectors, metal buildings are difficult to effectively insulate. The energy costs involved in heating and cooling a metal building can be relatively high. A considerable amount of thermal transfer takes place at the metal walls, and even more thermal transfer typically takes place at the ceiling or metal roof of the building. Conventional efforts to insulate metal building ceilings typically involve placing a layer of insulating material over the top surface of the upper flange of a purlin. Then the roof deck is attached to the upper flange of the purlin. This squeezes the insulating material above each purlin and results in a considerable R-value reduction and energy loss in those regions. The initial installation is done from the outside of the building by relatively highly paid steel workers, weather conditions permitting. The work can often be dangerous and difficult to do in windy or wet conditions.

Additional insulation can be added later from the inside by placing batt or blown insulation inside a flexible netting or fabric that is draped from the purlins. However, such insulated ceilings are not very energy efficient and cannot be washed when the fabric or insulation begins to discolor or get dirty. A low cost, energy efficient and reliable method of providing a well insulated washable ceiling or wall in a metal building is needed.

Therefore, a primary objective of the present invention is the provision of an improved insulated ceiling or wall for a metal building.

Another objective of this invention is the provision of improved methods for insulating a ceiling or wall of a metal building.

Another objective of this invention is the provision of an improved means for insulating a ceiling or wall of a metal building.

Another objective of this invention is the provision of an insulated ceiling that has a higher R-value than conventional ceilings due to thermal isolation of metal components and reduction of the total area where high thermal transfer can occur.

Another objective of this invention is the provision of a method of insulating a ceiling that can be done completely from inside the building once the roof has been installed.

Another objective of this invention is the provision of an insulated ceiling that provides a more effective moisture barrier.

Another objective of this invention is the provision of an insulated ceiling that is washable from inside the building.

Another objective of this invention is a provision of an insulated ceiling that is easy to install, attractive, energy efficient, durable and reliable in use.

These and other objectives will be apparent from the drawings, as well as from the description and claims that follow.

SUMMARY OF THE INVENTION

The present invention relates to means and methods for providing an insulated ceiling or wall. This invention is especially useful for insulating the ceiling of a metal building. The method of forming an insulated ceiling includes attaching an insulated panel to the lower flange of the purlins to form an insulatable space between the panel, the purlins, and the exterior skin of a building. The space is then filled with insulation material.

An insulation delivery system is provided for the filling process. This system is especially well-adapted for use with loose-fill insulation material. The delivery system includes a blower connected to a source of blowable insulating material, and a special manifold connected to the blower and adapted to deliver the material into the space. The manifold has a manifold plate that is slidingly insertable in the space. The manifold plate includes a peripheral seal and at least one air hole therethrough so that air can escape the space while the insulation is being blown in. The manifold allows the space to be filled with insulating material to a desired density or R-value.

The manifold plate can be formed in two or more slidable sections so as to be adjustable in length in at least one direction. The number and location of the air escape holes can be selected to achieve the desired results.

DETAILED DESCRIPTION OF THE PREFERRED EMBODIMENTS

Figure 1:
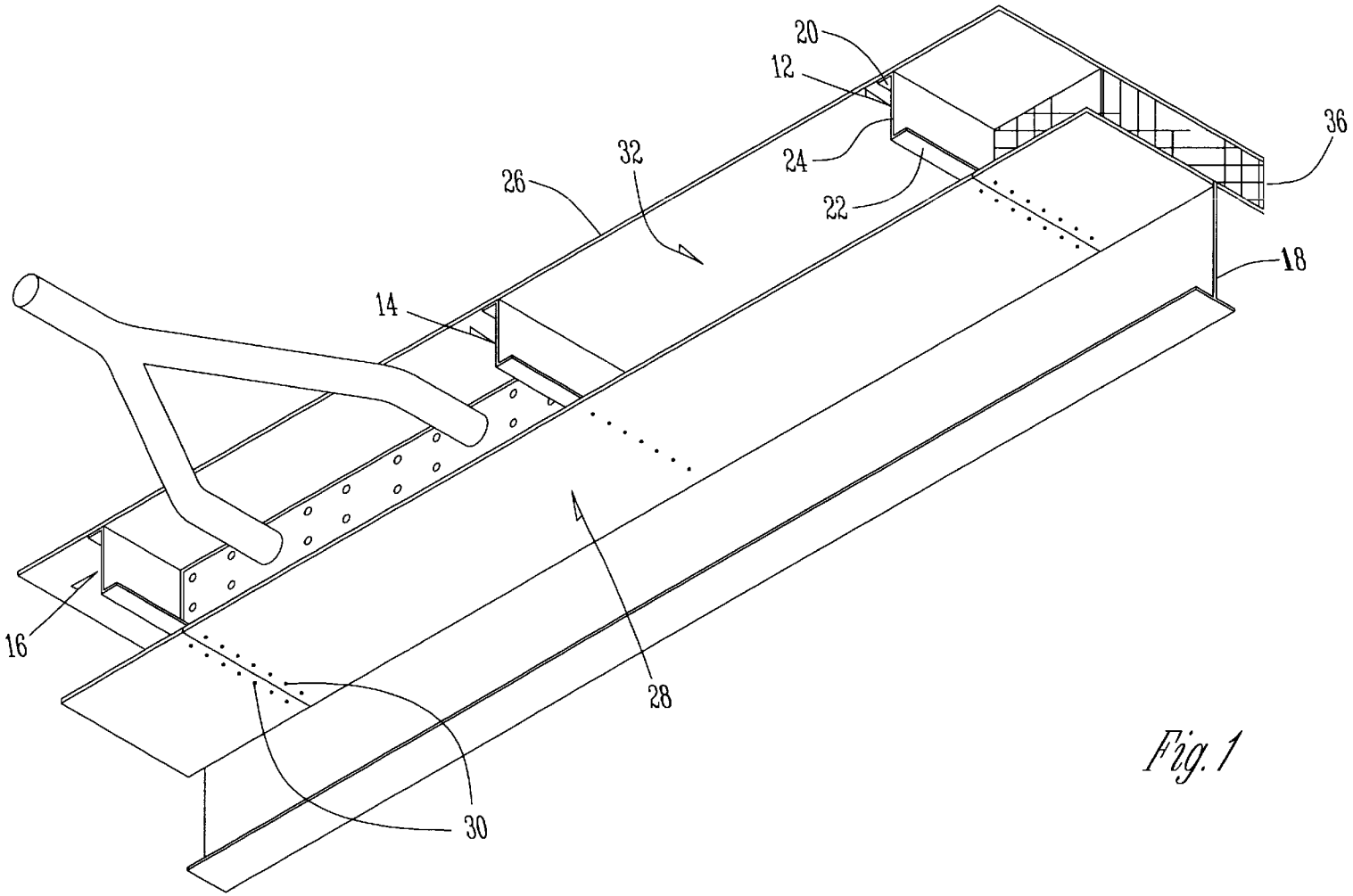
FIG. 1 is a perspective view of a section of the ceiling of the present invention.
Figure 2:
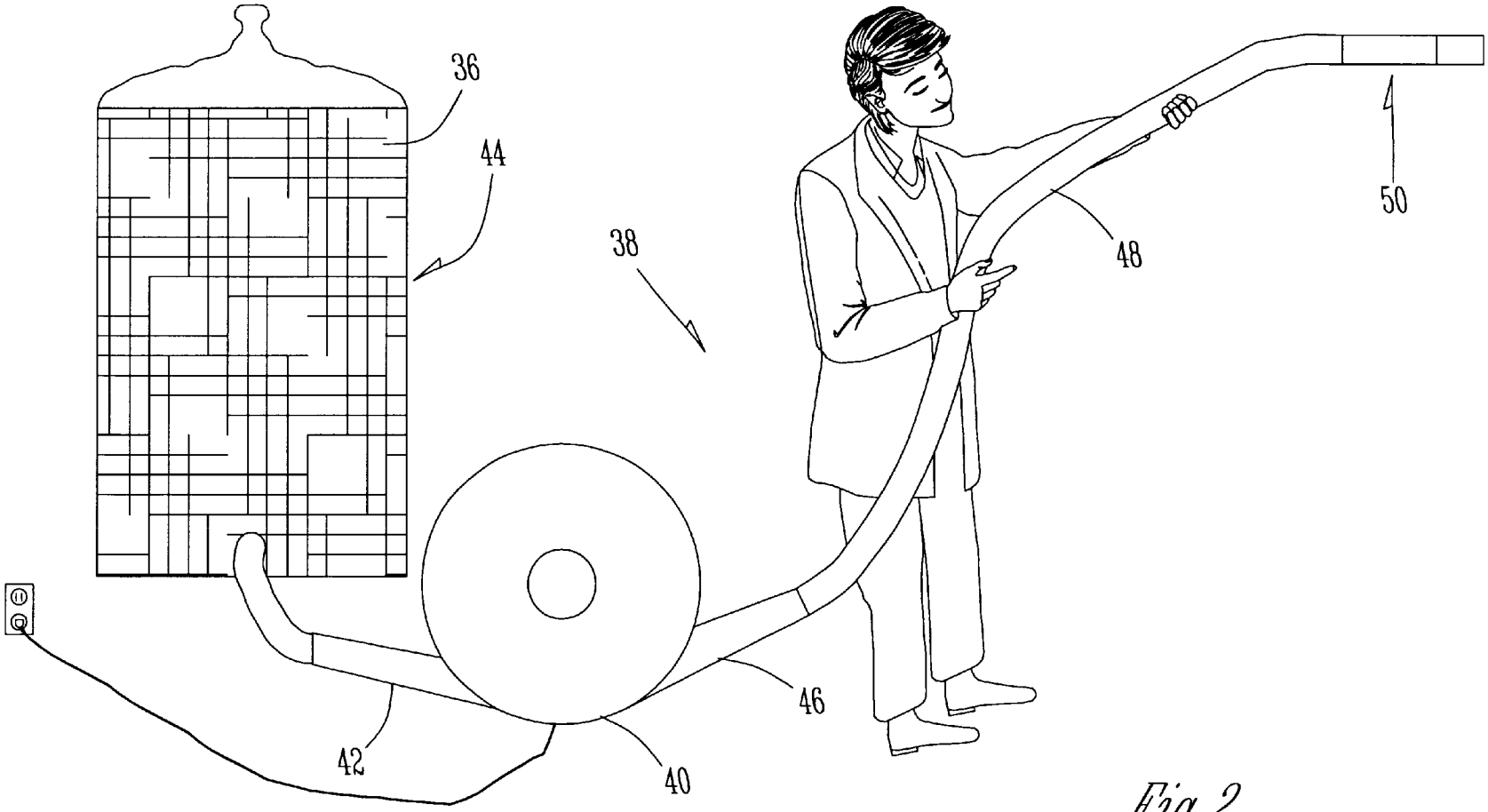
FIG. 2 is a perspective view of a means for installing the ceiling of FIG. 1.
Figure 3:
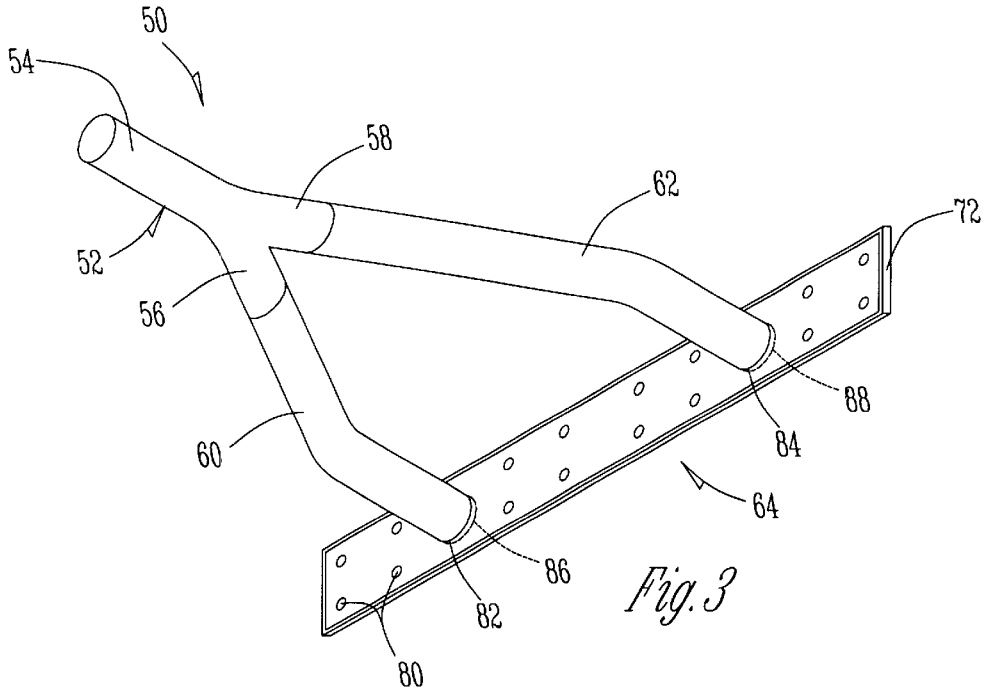
FIG. 3 is a perspective view of the manifold for blowing insulation according to the present invention.

The reference numeral 10 designates the insulated ceiling of this invention in the figures and the description below. Referring to FIG. 1, the ceiling 10 includes a plurality of spaced apart elongated purlins 12, 14, 16 that are supported by structural framing 18. In the preferred embodiment, which is best adapted to a metal building, the purlins 12, 14, 16 and the framing 18 are formed of steel or another rigid metallic material. The purlins 12, 14, 16 are preferably arranged parallel to each other.

The purlins 12, 14, 16 are substantially identical. Thus, only purlin 12 needs to be described in greater detail. Purlins 14, 16 have the same features and attributes. The purlin 12 has a transverse cross-section that is generally Z-shaped. However, other shapes will suffice for the transverse cross-section. For example, a generally C-shaped cross-section will also suffice. The purlin 12 has an upper flange 20, a lower flange 22, and an intermediate portion 24 that connects the upper and lower flanges.

A roof deck 26 engages and is attached to the upper or outer surface of the upper flanges 20 of the purlins 12, 14, 16. In the case of a metal frame building, the roof 26 is a sheet of metal that directly engages the outer surface of the upper flanges 20. The roof 26 is attached to the purlins 12, 14, 16 with conventional fasteners (not shown).

An insulated panel member 28 attaches to the bottom surface of the lower flange 22 of the purlins 12, 14, 16 with a plurality of conventional fasteners 30. Preferably the fasteners 30 are self-tapping fasteners with washers that spread the fastening load so as not to unduly damage the insulated panel member 28. Together the adjacent purlins 12, 14 or 14, 16, the roof 26, and the insulated panel member 28 define an insulatable space 32 therebetween. The insulatable space 32 has a closed end 34 delimited by a wall, purlin, or frame member (not shown) extending generally perpendicular to the purlins 12, 14, 16. The space 32 has an opening thereinto adjacent a side edge of the panel member 28. As shown, the panel member 28 comprises a number of individual panel sheets having a fixed width and being attached to the lower flanges 22 of the purlins 12, 14, 16, etc.

Figure 9:
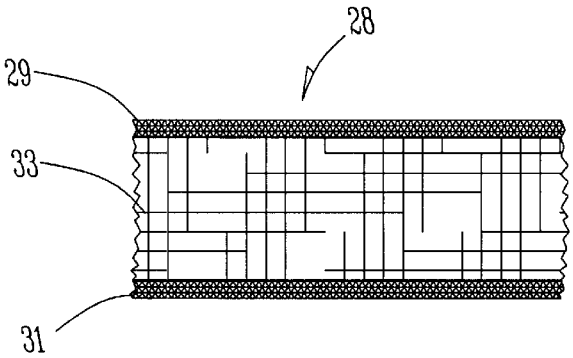
FIG. 9 is a cross-sectional view showing the panel member utilized in this invention in greater detail.

Alternatively, the panel member 28 can be a larger continuous sheet fastened to at least some of the purlins 12, 14, 16, etc. and extending almost completely across a full section or side of a roof or ceiling. Preferably the panel member 28 or the sheets forming it are substantially rigid, impermeable, and self-supporting once fastened to the purlins. FIG. 9 illustrates the components used to form the panel member 28. The panel member 28 includes thin, substantially rigid, substantially impermeable outer layers 29, 31 formed of a lightweight metal material, such as aluminum for example. Sandwiched between or joined to these outer layers is a substantially rigid foam core 33. The core 33 is preferably a glass fiber reinforced polyisocyanurate foam core product. The exposed surfaces of the outer layers 29, 31 can be embossed and acrylic coated, if desired. The preferred panel member is an insulation/finish board available from Celotex Corporation of Tampa, Florida under the trade designation THERMAX® Light Duty.

Referring again to FIG. 1, the insulatable space 32 is filled with an insulating material 36. For reasons that will become apparent when discussing the means for filling the insulatable space 32, a loose-fill insulation material is preferred. However, it is contemplated that at least a portion of the insulatable space 32 may be filled with batt type fiberglass insulation material. The insulatable spaced 32 is filled with insulating material 36 until the desired density or R-value is achieved for the ceiling 10.

As best seen in FIGS. 2–5 and 6A–6C, when loose-fill insulation material is utilized, a specialized insulation delivery system or means 38 is provided. The system 38 includes a portable electric blower 40 that has an inlet 42 connected to a source 44 of loose-fill insulation material 36 and an outlet 46 that is a connected via a flexible delivery hose 48 to a manifold assembly 50 for injecting the insulating material 36 into the insulatable space 32. Preferably the delivery hose 48 is of a sufficient inside diameter to permit the efficient flow of the insulating material 36. A hose 48 that has an inside diameter of approximately three inches is already well known in the art of building insulation and has been found to suffice for purposes of this invention.

The manifold assembly 50 includes a coupling 52 that is in turn connected by at least one hose or conduit to an inlet on the manifold plate 64. The coupling 52 is preferably hollow and Y-shaped so as to include a base portion 54 connected to the blower 40 by the hose 48, and a pair of diverging legs 56, 58. The legs 56, 58 respectively connect to a pair of hoses or inlet conduits 60, 62, that in turn are connected to a manifold plate 64. The preferably rigid manifold plate 64 has a front surface 66 directed away from the tubes 60, 62, a rear surface 68 directed toward the tubes 60, 62, and a peripheral edge 70. A rubber seal or gasket 72 is attached to the peripheral edge 70.

The height H of manifold plate 64 is selected or adapted to be slightly less than the height of the insulatable space 32. The height H of the manifold plate 64 roughly corresponds to the height of the purlins 12, 14, 16. Different manifold plates can be used for different purlin heights.

Figure 7:
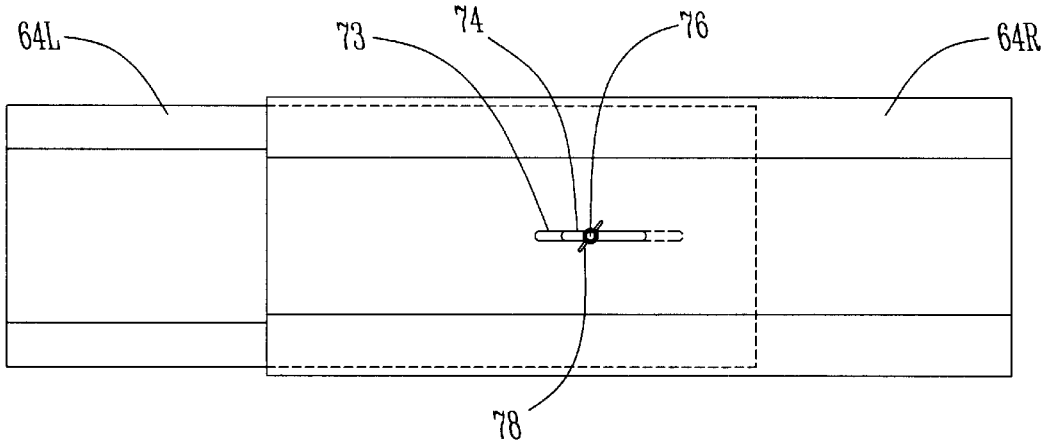
FIG. 7 is a rear elevation view of an adjustable length embodiment of the manifold of this invention. The inlet tubes and seal have been cut off for clarity.
Figure 8:
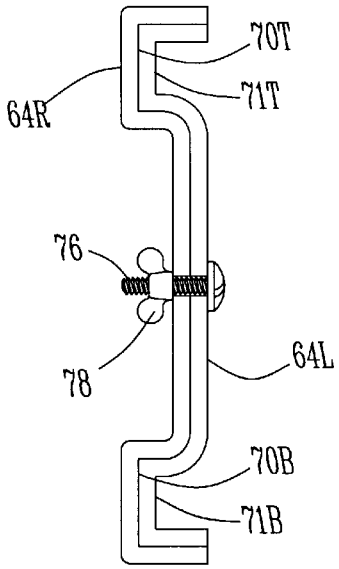
FIG. 8 is a cross-sectional view taken along line 8–8 in FIG. 7.

The length L of the manifold plate selected is adapted to be slightly less than the width of the insulatable space 32. Different length manifold plates may be used to fill different insulatable spaces. The length L of the manifold plate 64 roughly corresponds to the distance between the adjacent purlins 12, 14, 16. However, as an alternative, the length L of the manifold plate 64 can be made slidingly adjustable as understood in view of FIGS. 7–8. This is made possible by splitting the manifold plate 64 into left and right halves 64L, 64R and providing longitudinal slots 73, 74, a bolt 76 extending through the slots 73, 74, a wing nut 78 attached to the bolt 76, and matingly interlocking peripheral top and bottom edges 70T, 70B, 71T, and 71B. Of course, similar sliding adjustment may be provided for the height of the manifold plate 64 instead of the length. Making the tubes 60, 62 flexible instead of rigid will facilitate adjustability.

Figure 4:
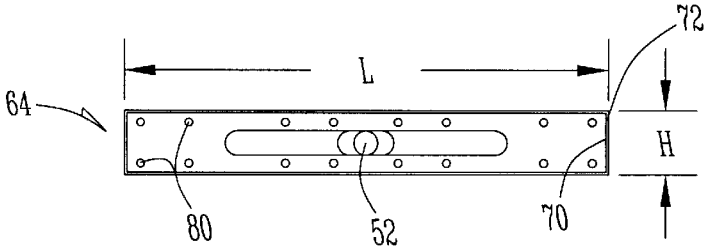
FIG. 4 is a rear elevation view of the manifold of FIG. 3, which shows the air escape holes and the peripheral gasket seal in greater detail.
Figure 5:
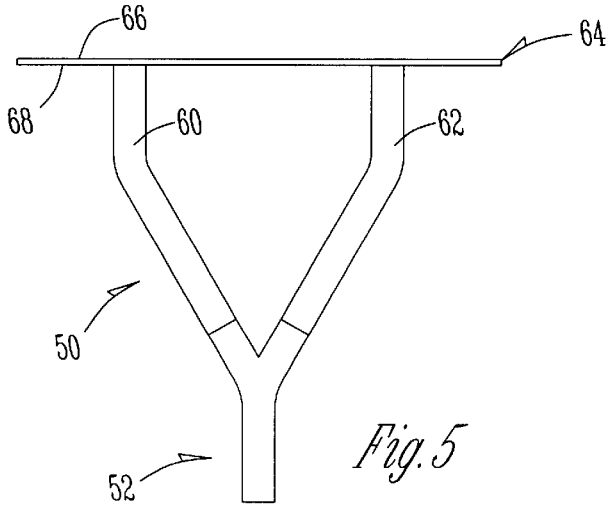
FIG. 5 is a top plan view of the manifold of FIG. 3.
Figure 6A:
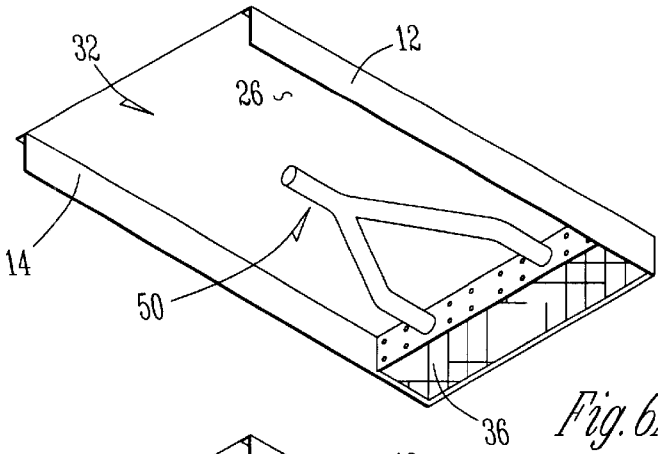
FIGS. 6A, 6B, and 6C are cutaway perspective views that sequentially depict a method of filling the insulatable space adjacent the roof with insulative material using the manifold of this invention. The insulated panel member has been removed for clarity.
Figure 6B:
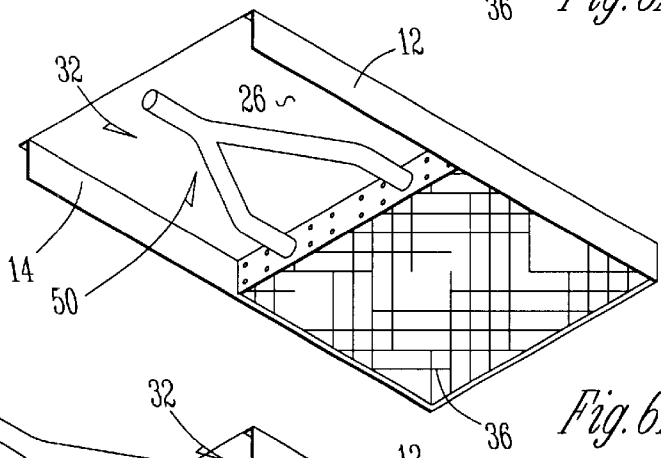
Figure 6C:
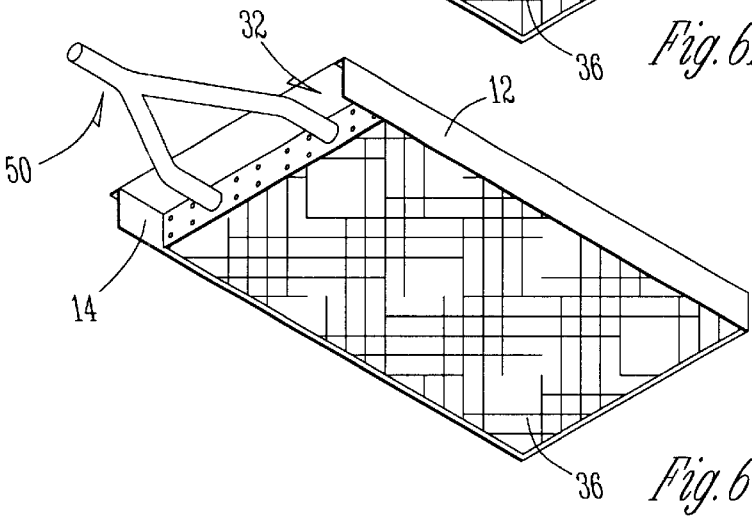

Referring again to FIG. 3, at least one small air escape hole 80 is provided in the manifold plate 64. Preferably a plurality of air escape holes 80 extend through the manifold plate 64 and are arranged in a pattern as shown in FIG. 4. An upper and lower row of holes 80 are vertically aligned. The manifold 64 includes at least one inlet opening at its rear surface and at least one outlet opening at its forward surface. When the pair of tubes 60, 62 are used, they connect to a pair of spaced inlet openings 82, 84. Then a pair of spaced outlet openings 86, 88 register with and fluidly connect to the inlet openings 82, 84 through a straight passageway in the manifold 64. Preferably several holes 80 surround the outlet openings 86, 88, with a higher concentration of them between the openings 86, 88. As will be understood later, relatively even spacing of the holes 80 is also advantageous for proper movement of the manifold 64 within the space 32.

In general, the method of installing the insulated ceiling of this invention may or may not utilize the means described above. Once sections of the roof deck 26 have been attached directly to the upper flanges 20 of the purlins 12, 14, 16, the basic method includes the steps of attaching the rigid insulated panel 28 (or panel sheets) to the lower flanges 22 so as to extend across the applicable adjacent purlins 12, 14, 16, etc. to form one or more insulatable spaces 32, then filling the insulatable spaces 32 with an insulative material 36. The material can be fiberglass batt insulation or loose-fill insulating material.

When utilizing loose-fill insulating material 36, the preferred method further includes the steps of providing the manifold 64, passing the manifold around a peripheral edge of the insulated panel 28 (See FIG. 1), slidingly and sealingly positioning the manifold 64 so that its outlet openings 86, 88 are directed toward the closed end of one of the insulatable spaces 32, connecting the manifold to the blower 40 and thereby to the source of loose-fill insulating material 36. The installer activates the blower 40 to deliver the loose-fill insulating material 36 into the space 32. As the space 32 fills with insulating material, air occupying the space must be displaced from the space through the holes 80 in the manifold 64. The accumulation of insulating material 36 in the space 32 also tends to force the manifold 64 rearwardly toward the opening of the space.

If the operator holds the manifold firmly in place within the space 32 adjacent its opening, the loose-fill insulating material 36 can fill the space to a desired density. The density and type of material used, of course, affect the R-value of the completed insulated ceiling 10. The air holes, weight, size, and seal of the manifold, as well as the material used and the pressure at which it is delivered, can be varied so that the manifold moves toward the opening of the space at a predetermined rate that will automatically achieve the desired density and R-value as the manifold ejects itself from the space. See FIGS. 6A, 6B, and 6C.

The means and methods of the present invention are also adaptable to the use of insulation of the expanding foam type. The invention can also be adapted for use in insulating the walls of a building. One of the most advantageous features of the invention is that all of the insulating can be done from the inside of the building by relatively less costly unskilled laborers once the exterior skin (wall or ceiling) is attached to the building. The contractor does not need to use highly paid steel workers to do the insulating work. Thus, it can be seen that the present invention at least accomplishes its stated objectives.

In the drawings and specification, there has been set forth a preferred embodiment of the invention, and although specific terms are employed, these are used in a generic and descriptive sense only and not for the purpose of limitation. Changes in the form and the proportion of parts as well as in the substitution of equivalents are contemplated as circumstances may suggest or render expedient without departing from the spirit or scope of the invention as further defined in the following claims.

What is claimed is:

1. A method of forming a first insulated ceiling section in a building having a metal roof engaging and being attached to an outer surface on a pair of spaced elongated first and second metal purlins, the steps of the method comprising:

a) attaching a substantially rigid impermeable insulated panel sheet having a fixed width to an inner surface of the first and second purlins spaced apart from the roof so as to define an insulatable space between the first and second purlins, the roof, and the insulated panel sheet, the insulatable space having a closed end; and b) filling the insulatable space with a insulating material.

2. The method of claim 1 wherein the step of filling the insulatable space comprises:

c) providing a manifold having an outer peripheral edge adapted to slidingly and sealingly fit within the insulatable space, the manifold having at least one outlet for delivering insulating material and a plurality of air exhaust holes for allowing air to escape from the insulatable space;

d) passing the manifold around a peripheral edge of the panel sheet and into the insulatable space;

e) positioning the manifold so that the outlet is generally directed toward the closed end of the insulatable space and the peripheral edge is in sealing engagement with the roof, the panel sheet and the first and second purlins;

f) connecting the manifold to a blower connected to a source insulating material;

g) activating the blower so as to deliver insulating material through the manifold into the insulatable space, thereby displacing air from the insulatable space through the air exhaust holes;

h) running the blower until a desired density of insulating material fills the insulatable space;

i) deactivating the blower; and j) removing the manifold from the insulatable space.

3. The method of claim 2 comprising repeating steps a) through j) on a second section of ceiling adjacent the first section of ceiling, positioning the panel sheet for the second section adjacent the panel sheet for the first section so as to define a joint therebetween.

4. The method of claim 3 comprising caulking the joint between the adjacent insulated panel sheets.

5. The method of claim 4 comprising applying a vapor retardant tape to the joint.

6. The method of claim 1 comprising providing the insulated panel sheet in the form of a pair of spaced impermeable rigid outer sheets and a foam core of insulation sandwiched between and engaged by the outer sheets.

7. The method of claim 1 wherein the insulating material used is a loose-fill insulation material.

8. The method of claim 2 wherein the step of positioning the manifold in the space includes positioning the manifold adjacent the closed end of the insulatable space.

9. The method of claim 2 wherein the step of running the blower continues until the insulative material delivered into the space to force the manifold plate/to move a desired distance away from the closed end of the insulatable space.

10. A method of forming an insulated section in a building having an exterior skin attached to an outer surface on a pair of spaced elongated first and second purlins, the steps of the method comprising:

a) attaching an insulated panel sheet to the first and second purlins, the panel sheer being spaced apart from the exterior skin so as to define an insulatable space between the first and second purlins, the exterior skin, and the insulated panel sheet, the insulatable space having a closed end, a width, a height and a depth;

b) providing a manifold adapted to slidingly fill the width and height of the insulatable space, the manifold having at least one outlet for delivering insulating material and a plurality of air exhaust holes for allowing air to escape from the insulatable space;

c) positioning the manifold in the insulatable space so that the outlet is generally directed toward the closed end of the insulatable space;

d) connecting the manifold to a blower connected to a source insulating material; and e) running the blower so as to deliver insulating material through the manifold into the insulatable space until a desired density of insulating material fills the insulatable space, thereby displacing air from the insulatable space through the air exhaust holes.

11. The method of claim 10 wherein the insulating material used is a loose-fill insulation material.

12. An apparatus for filling a ceiling or wall section with insulating material comprising:

a blower connected to a source of insulating material;

a manifold assembly including an inlet conduit connected to the blower, a manifold plate having front and rear surfaces and a peripheral edge, and a seal attached to and extending around the peripheral edge;

the manifold plate having at least one inlet opening therein, at least one outlet opening connected to the inlet opening, and at least one spaced air hole therethrough.

13. The apparatus of claim 12 wherein the peripheral edge of the manifold plate is substantially rectangular.

14. The apparatus of claim 12 wherein the manifold plate is rigid.

15. The apparatus of claim 12 wherein the at least one outlet opening is a pair of laterally spaced outlet openings and the at least one inlet opening is a pair of laterally spaced inlet openings that are registered with the outlet openings.

16. The apparatus of claim 15 comprising a hollow Y-shaped coupling member including a base portion connected to the blower and a pair of legs diverging from the base portion and being connected to the inlet openings of the manifold plate.

17. The apparatus of claim 16 comprising a pair of rigid tubes connecting the legs of the coupling member to the inlet openings of the manifold plate.

18. The apparatus of claim 12 wherein the blower is a portable electric blower.

19. The apparatus of claim 12 wherein the at least one air hole includes a first plurality of air holes arranged in an upper row located above the at least one outlet and a second plurality of air holes arranged in a lower row located below the at least one outlet.

20. The apparatus of claim 19 wherein the first plurality of air holes are vertically aligned with the second plurality of air holes.

21. An insulated ceiling for a building comprising:

a plurality of spaced adjacent elongated metal purlins; the purlins each including an upper flange, a lower flange, and an intermediate portion interconnecting the upper flange and the lower flange;

a metal roof having a bottom surface attached to the upper flange;

a substantially rigid and impermeable insulated panel member attached to the lower flange of the purlins;

the metal roof, pairs of the adjacent purlins, and the panel member together defining at least one insulatable space therebetween that extends longitudinally with respect to the pairs of adjacent purlins; and insulating material installed to a predetermined density in the insulatable space so as to provide a desired R-value for the insulated ceiling.

22. The ceiling of claim 21 wherein the adjacent purlins are generally parallel to each other.

23. The ceiling of claim 22 wherein the panel member includes a plurality of individual panel sheets having opposite side edges with a fixed width therebetween corresponding to the spacing between adjacent purlins, each panel sheet being fastened to the adjacent purlins by a plurality of fasteners extending through the panel sheet adjacent the side edges.

24. The ceiling of claim 21 wherein the metal roof is in direct surface contact with the upper flange of the purlins.

25. The ceiling of claim 21 wherein the panel member includes a substantially rigid impermeable top layer, a substantially rigid impermeable bottom layer parallel to the top layer, and a foam core of insulating material joining the top layer to the bottom layer.

26. The ceiling of claim 21 wherein the insulated panel member is in direct surface contact with the lower flange of the purlins.

27. The ceiling of claim 21 wherein the purlins are metal and formed so as to have a generally Z-shaped vertical transverse cross-section.

* * * * *